US006761151B2

(12) United States Patent
Kojima

(10) Patent No.: US 6,761,151 B2
(45) Date of Patent: Jul. 13, 2004

(54) HIGH-PRESSURE FUEL SUPPLY SYSTEM OF AN INTERNAL COMBUSTION ENGINE AND CONTROL METHOD THEREOF

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/310,770

(22) Filed: Dec. 6, 2002

(65) Prior Publication Data

US 2003/0116134 A1 Jun. 26, 2003

(30) Foreign Application Priority Data

Dec. 18, 2001 (JP) ..... 2001-384680

(51) Int. Cl.[7] ..... F02M 41/00
(52) U.S. Cl. ..... 123/458; 123/179.17
(58) Field of Search ..... 123/458, 179.17, 123/446, 510, 463, 456, 514, 506

(56) References Cited

U.S. PATENT DOCUMENTS 5,197,438 A * 3/1993 Kumano et al. ..... 123/506
5,878,718 A 3/1999 Rembold et al.
6,065,436 A 5/2000 Koga et al.
6,145,490 A 11/2000 Heidenfelder et al.
6,230,684 B1 * 5/2001 Furuhashi et al. ..... 123/467
6,336,445 B1 * 1/2002 Yamazaki et al. ..... 123/506
6,450,147 B2 * 9/2002 Demura et al. ..... 123/458

FOREIGN PATENT DOCUMENTS

| | | |
|---|---|---|
| DE | 195 39 885 A1 | 11/1996 |
| EP | 0 979 940 A2 | 2/2000 |
| EP | 1 013 914 A1 | 6/2000 |
| EP | 1 124 055 A2 | 8/2001 |
| JP | A 11-22576 | 1/1999 |
| JP | A 2000-8917 | 1/2000 |

* cited by examiner

*Primary Examiner*—Mahmoud Gimie
(74) *Attorney, Agent, or Firm*—Oliff & Berridge, PLC

(57) ABSTRACT

The high-pressure fuel supply system of an internal combustion engine includes a high-pressure portion for supplying fuel to a plurality of fuel injection valves, a high-pressure pump, and a low-pressure pump for supplying fuel to the high-pressure pump. Upon starting of the engine, the high-pressure fuel supply system starts fuel injection after a pressure in the high-pressure portion is raised to a preset pressure higher than a rated discharge pressure of the low-pressure pump by the high-pressure pump. In view of a fuel consumption amount consumed from the high-pressure portion through the fuel injection valve and a fuel supply amount supplied to the high-pressure portion by the high-pressure pump, the preset pressure at which the fuel injection is started is set so that first fuel injection to each cylinder of a plurality of cylinders by each of the plurality of fuel injection valves is conducted at a pressure higher than the rated discharge pressure of the low-pressure pump.

22 Claims, 1 Drawing Sheet

HIGH-PRESSURE FUEL SUPPLY SYSTEM OF AN INTERNAL COMBUSTION ENGINE AND CONTROL METHOD THEREOF

INCORPORATION BY REFERENCE

The disclosure of Japanese Patent Application No. 2001-384680 filed on Dec. 18, 2001, including the specification, drawings and abstract is incorporated herein by reference in its entirety.

BACKGROUND OF THE INVENTION

1. Field of Invention

The invention relates to a high-pressure fuel supply system of an internal combustion engine, and a control method thereof.

2. Description of Related Art

In order to inject fuel directly into cylinders of an internal combustion engine, high-pressure fuel must be supplied to each fuel injection valve. A high-pressure fuel supply system for this purpose is known in the art.

A conventional high-pressure fuel supply system includes a delivery pipe leading to each fuel injection valve, a high-pressure pump for force-feeding high-pressure fuel into the delivery pipe, and a low-pressure pump connected to the intake side of the high-pressure pump in order to ensure fuel intake of the high-pressure pump.

When operating an engine, the high-pressure pump force-feeds fuel. This enables the pressure in the delivery pipe to be held at a value close to a desired high fuel pressure suitable for satisfactory fuel injection. However, the high-pressure pump is commonly an engine-driven pump. Therefore, the high-pressure pump cannot force-feed a sufficient amount of fuel at an extremely low engine speed in a cranking period upon starting of the engine. As a result, it takes a very long time to raise the pressure in the delivery pipe to the desired high fuel pressure.

It is impractical to spend such a long time upon starting the engine. Therefore, at the risk of impeding satisfactory fuel injection, fuel injection is commonly started when the fuel pressure in the delivery pipe is lower than the desired high fuel pressure.

Japanese Patent Laid-Open Publication No. 2000-8917 proposes the following method: when the fuel pressure in a delivery pipe is lower than a prescribed pressure upon starting an engine, fuel discharged from a low-pressure pump is introduced into the delivery pipe through a high-pressure pump by, e.g., keeping a spill valve of the high-pressure pump in the open state. Fuel injection is thus started at a fuel pressure (in the delivery pipe) equal to a rated discharge pressure of the low-pressure pump. On the other hand, when the fuel pressure in the delivery pipe is equal to or higher than the prescribed pressure, the delivery pipe is compressed by the high-pressure pump, and fuel injection is started at a fuel pressure higher than the rated discharge pressure of the low-pressure pump.

When the engine is started at an extremely low temperature, injected fuel is less likely to be evaporated. In order to assure reliable ignition, a large amount of fuel must be injected at least in the first fuel injection to each cylinder on the assumption that only a part of the injected fuel is evaporated.

A low-pressure pump is commonly an electrically driven pump. Therefore, it is possible to force-feed a relatively large amount of fuel from the time the engine is started. Accordingly, in the case where fuel injection is started at a pressure (in the delivery pipe) equal to the rated discharge pressure of the low-pressure pump in the high-pressure fuel supply system described in the above Japanese Patent Laid-Open Publication No. 2000-8917, a sufficient amount of fuel is discharged from the low-pressure pump and supplied to the delivery pipe right after the fuel is injected to the first cylinder. As a result, the pressure in the delivery pipe immediately reaches the rated discharge pressure of the low-pressure pump even if a large amount of fuel is injected as in the case where the engine is started at an extremely low temperature. Accordingly, fuel injection to the following cylinder can be conducted at the rated discharge pressure of the low-pressure pump. However, even if the fuel is injected at the rated discharge pressure of the low-pressure pump, it is difficult to evaporate an intended amount of fuel within the cylinder due to a low injection penetration, i.,e. a long distance over which the fuel injected remains in a liquid state. As a result, it is difficult to implement satisfactory starting of the engine.

On the other hand, in the case where the fuel in the delivery pipe is compressed by the high-pressure pump and fuel injection is started at a pressure higher than the rated discharge pressure of the low-pressure pump, fuel injection to the first cylinder can be conducted in a relatively satisfactory manner upon starting the engine at an extremely low temperature. However, in a case where the engine is started at an extremely low temperature, a large amount of fuel is injected to the first cylinder. In such a case, the fuel pressure in the delivery pipe becomes lower than the rated discharge pressure of the low-pressure pump after the fuel injection to the first cylinder, thereby making fuel injection to the following cylinder difficult. Moreover, the high-pressure pump has a small size. Therefore, even if the high-pressure pump force-feeds the fuel to the delivery pipe before the fuel injection to the following cylinder, the amount of fuel discharged from the high-pressure pump in each discharge operation is often smaller than the amount of fuel injected to each cylinder when the engine is started at an extremely low temperature. Therefore, even if the fuel injection to the following cylinder is conducted at a pressure higher than the rated discharge pressure of the low-pressure pump, it is difficult to inject the fuel to all of the remaining cylinders at a fuel pressure higher than the rated discharge pressure of the low-pressure pump. Accordingly, it is also difficult to implement satisfactory starting of the engine.

SUMMARY OF THE INVENTION

The invention thus provides a high-pressure fuel supply system of an internal combustion engine and a control method thereof, which enable implementation of a satisfactory starting of the engine.

A first aspect of the invention relates to a high-pressure fuel supply system of an internal combustion engine. The high-pressure fuel supply system includes a high-pressure portion for supplying fuel to a plurality of fuel injection valves, a high-pressure pump for supplying fuel to the high-pressure portion, and a low-pressure pump for supplying fuel to the high-pressure pump. Upon starting the engine, the high-pressure fuel supply system starts fuel injection after a pressure in the high-pressure portion is raised to a preset pressure, higher than a rated discharge pressure of the low-pressure pump, by the high-pressure pump. Furthermore in the high-pressure fuel supply system, in view of a fuel consumption amount consumed from the high-pressure portion through the fuel injection valve and a fuel supply amount supplied to the high-pressure portion by the high-pressure pump, the preset pressure at which the fuel injection is started is set so that first fuel injection to each cylinder of a plurality of cylinders by each of the plurality of fuel injection valves is conducted at a pressure higher than the rated discharge pressure of the low-pressure pump.

A second aspect of the invention relates to a method for controlling a high-pressure fuel supply system of an internal combustion engine. The high-pressure fuel supply system includes a high-pressure portion that supplies fuel to a plurality of fuel injection valves, a high-pressure pump for supplying fuel to the high-pressure portion, and a low-pressure pump for supplying fuel to the high-pressure pump. The method includes the steps of calculating a fuel consumption amount consumed from the high-pressure portion through the fuel injection valve; calculating a fuel supply amount supplied to the high-pressure portion by the high-pressure pump; and setting a preset pressure in the high-pressure portion, in view of the fuel consumption amount and the fuel supply amount, at which fuel injection is started so that first fuel injection to each cylinder of a plurality of cylinders by each of the plurality of fuel injection valves is conducted at a pressure higher than a rated discharge pressure of the low-pressure pump.

BRIEF DESCRIPTION OF THE DRAWINGS

The foregoing and further objects, features and advantages of the invention will become apparent from the following description of preferred exemplary embodiments with reference to the accompanying drawings, wherein like numerals are used to represent like elements and wherein.

DETAILED DESCRIPTION OF PREFERRED EMBODIMENTS

Figure 1:
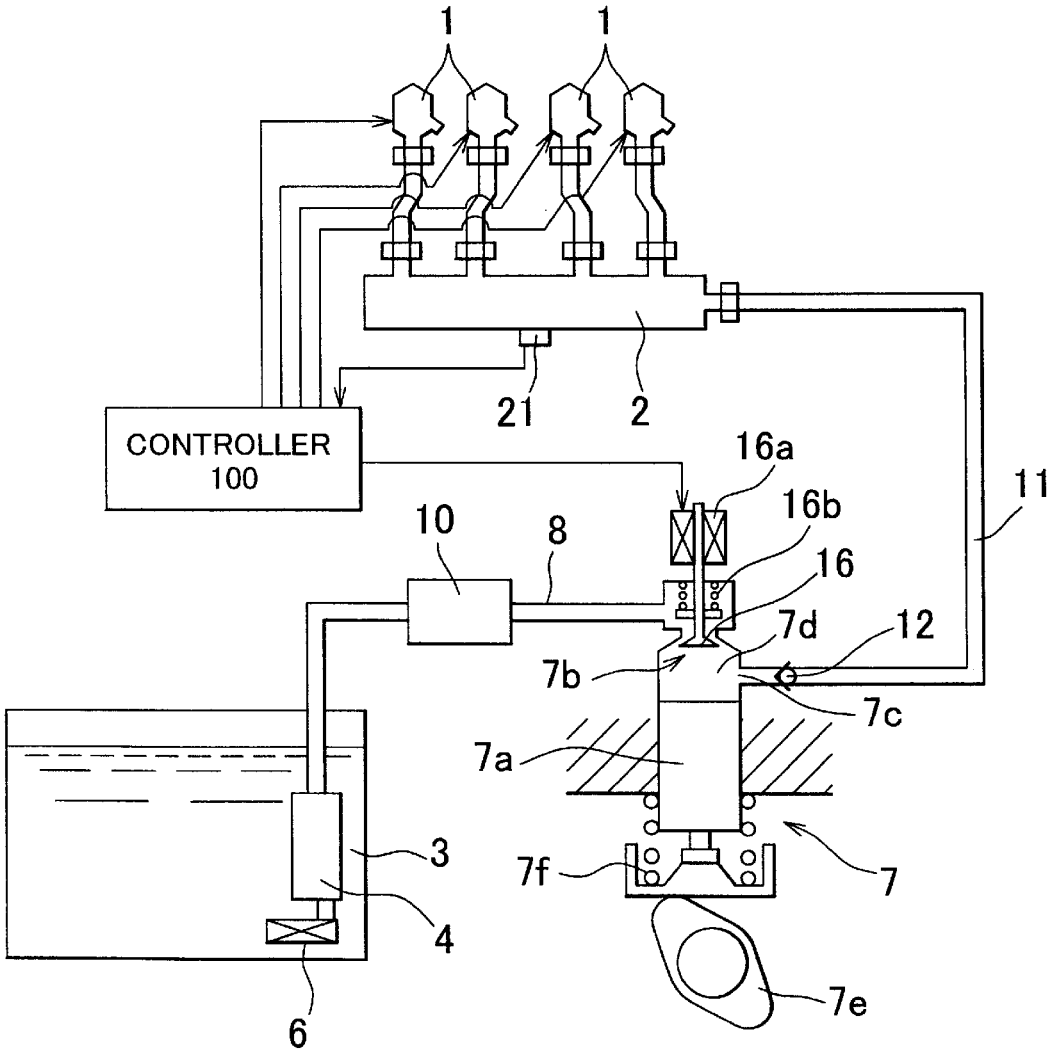
FIG. 1 schematically shows a high-pressure fuel supply system according to an exemplary embodiment of the invention.

FIG. 1 schematically shows a high-pressure fuel supply system according to an exemplary embodiment of the invention. Each fuel injection valve 1 injects fuel directly into a corresponding cylinder of an internal combustion engine. A delivery pipe 2 supplies high-pressure fuel to each fuel injection valve 1. A low-pressure pump 4 is provided within a fuel tank 3. The low-pressure pump 4 is a battery-driven, electrically driven pump having a rated discharge pressure of, e.g., 0.3 MPa. The low-pressure pump 4 is operated in response to an ON signal of a starter switch. A filter 6 is provided on the intake side of the low-pressure pump 4 in order to remove foreign matters from the fuel which is placed into the tank 3.

A high-pressure pump 7 keeps the fuel pressure in the delivery pipe 2 at a value close to a target high fuel pressure. The high-pressure pump 7 is an engine-driven pump that is driven by a cam 7*e* operating together with a crankshaft. Rotation of the crankshaft is started by a starter (not shown) upon cranking. The starter in response to an ON signal of a starter switch. The high-pressure pump 7 introduces fuel into a cylinder 7*d* through an intake port 7*b* and discharges the fuel from a discharge port 7*c*. For this purpose, the high-pressure pump 7 has a plunger 7*a* which slides within the cylinder 7*d*. The intake port 7*b* is connected to the discharge side of the low-pressure pump 4 through a low-pressure pipe 8. The discharge port 7*c* is connected to the delivery pipe 2 through a high-pressure pipe 11. A filter 10 is also provided in the low-pressure pipe 8 in order to remove foreign matters from the fuel.

In the intake stroke of the high-pressure pump 7, a spring 7*f* moves the plunger 7*a* so as to expand the space in the cylinder 7*d*. In the discharge stroke of the high-pressure pump 7, the cam 7*e* moves the plunger 7*a* so as to reduce the space in the cylinder 7*d*. A valve element 16 opens and closes the intake port 7*b*. A spring 16*b* always biases the valve element 16 in the valve opening direction. A solenoid 16*a* is controlled by the controller 100 and biases the valve element 16 in the valve closing direction against the biasing force of the spring 16*b*. In the intake stroke of the high-pressure pump 7, the solenoid 16*a* is not excited, whereby the valve element 16 is opened by the spring 16*b*. As a result, the fuel is introduced from the low-pressure pipe 8 into the cylinder 7*d* through the intake port 7*b*. As described before, the fuel thus introduced has been raised to 0.3 MPa by the low-pressure pump 4. Therefore, in the intake stroke of the high-pressure pump 7, no fuel vapor is generated within the low-pressure pipe 8 by a negative pressure.

On the other hand, in the discharge stroke of the high-pressure pump 7, the solenoid 16*a* is excited at a desired timing in order to close the valve element 16. Before the valve element 16 is closed, the fuel in the cylinder 7*d* is returned to the low-pressure pump 4 through the low-pressure pipe 8 without being force-fed into the high-pressure delivery pipe 2. After the valve element 16 is closed, however, the fuel in the cylinder 7*d* is force-fed into the delivery pipe 2. In this high-pressure fuel supply system, the discharge stroke of the high-pressure pump 7 occurs every time the fuel is injected into two cylinders. The timing of closing the valve element 16 is controlled in order to adjust the amount of fuel to be force-fed into the delivery pipe 2 based on the previous fuel injection amount to the two cylinders. In this way, the fuel pressure in the delivery pipe 2 can be held at a value close to the target high fuel pressure.

A check valve 12, that is opened at a preset pressure, is provided in the high-pressure pipe 11 in order to prevent backflow of the fuel by pressure pulsation generated by the high-pressure pump 7. A pressure sensor 21 monitors the fuel pressure in the delivery pipe 2. A pressure signal detected by the pressure sensor 21 is transmitted to the controller 100. Then, the controller 100 controls the fuel injection by the fuel injection valve 1 and the excited state of the solenoid 16*a* on the basis of the received pressure signal.

Of the fuel discharged by the plunger 7*a*, an unnecessary amount of fuel is returned to the fuel tank 3 through the low-pressure pipe 8. In this case, if the unnecessary amount of fuel is returned to the fuel tank 3, the high-pressure fuel flows back within the low-pressure pump 4. In order to prevent such backflow, the low-pressure pipe 8 may communicate with the fuel tank 3 through a safety valve that is opened at a pressure slightly higher than the rated discharge pressure of the low-pressure pump 4.

As long as the high-pressure pump 7 operates in a satisfactory manner after starting of the engine, fuel can be discharged as intended and the delivery pipe 2 can be kept at a pressure close to the target high fuel pressure. As a result, the fuel can be injected through the fuel injection valves 1 in a satisfactory manner.

Upon starting of the engine, the fuel pressure in the delivery pipe 2 is decreased to an amount approximately equal to the atmospheric pressure. Therefore, the fuel pressure in the delivery pipe 2 must be quickly raised to start fuel injection.

As described before, since the low-pressure pump 4 is an electrically driven pump, it is possible to force-feed a relatively large amount of fuel from the time the engine is started. Accordingly, upon starting of the engine, the fuel discharged from the low-pressure pump 4 can be continuously supplied to the delivery pipe 2 through the high-pressure pump 7 if the valve element 16 of the high-pressure pump 7 is kept in the open state even in the discharge stroke. As a result, the pressure in the delivery pipe 2 can be immediately raised to the rated discharge pressure of the low-pressure pump 4.

However, even if the fuel is injected at the rated discharge pressure of the low-pressure pump 4, a low injection penetration hinders a large frictional force from being generated between the injected fuel and the intake air within the cylinder while the injected fuel is being scattered within the cylinder. As a result, the fuel is neither atomized nor evaporated sufficiently. It is therefore impossible to form within the cylinder a mixture having excellent ignitionability. Accordingly, it is preferable to inject the fuel at least at a pressure higher than the rated discharge pressure of the low-pressure pump 4 even upon starting of the engine.

In the present exemplary embodiment, fuel injection is started as soon as the pressure in the delivery pipe 2 is raised to a preset value higher than the rated discharge pressure of the low-pressure pump 4 upon starting the engine. In order to quickly raise the pressure in the delivery pipe 2 to the preset value, the high-pressure pump 7 is required to force-feed the fuel in the maximum discharge amount. In order to implement this, the valve element 16 must be closed as soon as the discharge stroke of the high-pressure pump 7 is started. Upon starting the engine, however, which cylinder is in what stroke cannot be determined until a cylinder determining sensor for generating a pulse at every intake top dead center of the first cylinder or the like detects the pulse and cylinder determination is completed. In other words, the crank angle cannot be determined. Accordingly, it cannot be determined whether the high-pressure pump 7 operating together with the crankshaft is in the intake stroke or the discharge stroke. It is therefore impossible to close the valve element 16 as soon as the discharge stroke is started.

In the present embodiment, the solenoid 16*a* is not excited and the valve element 16 is kept in the open state at least during the period from the start of a cranking operation until the cylinder is determined. The fuel is thus force-fed from the low-pressure pump 4 to the delivery pipe 2. When the cylinder is determined, the valve element 16 is closed as soon as the discharge stroke of the high-pressure pump 7 is started. As a result, the fuel is force-fed to the delivery pipe 2 in the maximum discharge amount of the high-pressure pump 7. Fuel injection is conducted after the fuel pressure in the delivery pipe 2 becomes a preset pressure by the force-feed of the fuel to the delivery pipe 2. The preset pressure is a fuel pressure P to be hereinafter described.

The present exemplary embodiment may be modified as follows: before the cylinder is determined, the controller 100 may repeatedly apply a command to close the valve to the solenoid 16*a* at intervals shorter than half a cycle (the total period of an intake stroke and a discharge stroke) of the high-pressure pump 7 at the engine speed in the cranking operation. In this case, the valve element 16 is reliably closed in the discharge stroke. Once the valve element 16 is closed in the discharge stroke, the fuel pressure in the cylinder 7*d* of the high-pressure pump 7 is raised and the valve element 16 is kept in the closed state even if excitation of the solenoid 16*a* is discontinued. This enables the high-pressure pump 7 to force-feed the fuel in the discharge stroke after the valve element 16 is closed. The shorter the intervals at which the command to close the valve element 16 is applied, the earlier the valve element 16 is closed in the discharge stroke of the high-pressure pump 7. As a result, the high-pressure pump 7 can force-feed the fuel in an approximately maximum discharge amount even before the cylinder is determined. In other words, upon starting the engine, the fuel pressure in the delivery pipe 2 may be raised by applying the command to close the valve element 16 at shorter intervals.

Upon starting the engine, the fuel injected in the first fuel injection to each cylinder is not sufficiently evaporated due to a low temperature in the cylinder. In order to ensure reliable ignition, it is necessary to increase the fuel injection amount. When the engine is started at an extremely low temperature, the fuel is not sufficiently evaporated in the cylinder in the first fuel injection. Accordingly, an especially large amount of fuel must be injected in the first fuel injection.

The high-pressure pump 7 generally has a small size in view of mountability in a vehicle and reduction in costs. Therefore, the high-pressure pump 7 is not intended for injection of a large amount of fuel. In the present embodiment, the high-pressure pump 7 force-feeds the fuel to the delivery pipe 2 every time the fuel is injected to the two cylinders. However, the maximum discharge amount of the high-pressure pump is smaller than the total amount of fuel injected to two cylinders when the engine is started at an extremely low temperature. In fact, the maximum discharge amount of the high-pressure pump is smaller than the amount of fuel injected to a single cylinder when the engine is started at an extremely low temperature. In other words, when the engine is started at an extremely low temperature, the fuel discharge amount of the high-pressure pump of the present exemplary embodiment per fuel injection is smaller than the fuel injection amount in the first fuel injection to each cylinder. The fuel discharge amount per fuel injection will be described specifically. In the present exemplary embodiment, the fuel discharged from the high-pressure pump in each discharge operation is used for fuel injection to two cylinders. Therefore, the fuel injection amount per cylinder is equal to half the maximum fuel discharge amount.

It is now assumed that the fuel pressure in the delivery pipe 2 at which fuel injection is started is simply preset. Especially when the engine is started at an extremely low temperature, the fuel pressure in the delivery pipe 2 is significantly reduced after the first fuel injection to the first cylinder. The fuel pressure in the delivery pipe 2 reaches the preset pressure right after the high-pressure pump force-feeds the fuel, and the first fuel injection to the first cylinder is started as soon as the fuel pressure in the delivery pipe 2 reaches the preset pressure. Therefore, the first fuel injection to the second cylinder is conducted at the reduced fuel pressure in the delivery pipe 2 without force-feeding the fuel by the high-pressure pump.

As described above, the maximum discharge amount of the high-pressure pump is smaller than the fuel injection amount per cylinder. Therefore, even if the high-pressure pump force-feeds the fuel in the maximum discharge amount, the fuel pressure in the delivery pipe 2 is not recovered before the first fuel injection to the second cylinder. Since the first fuel injection to the remaining two cylinders is conducted thereafter, the fuel pressure in the delivery pipe 2 is absolutely lower than the rated discharge pressure of the low-pressure pump at the time of the first fuel injection to the last cylinder, i.e., the last fuel injection in the first fuel injection to each cylinder. Therefore, at least in the last cylinder, the injection penetration drops and the fuel is not sufficiently evaporated. Therefore, reliable ignition of a mixture formed in the cylinder is not ensured, whereby misfire is almost likely to occur. Accordingly, it is difficult to implement satisfactory starting of the engine.

In the present exemplary embodiment, a fuel pressure drop dP in the delivery pipe 2 during the period from the first fuel injection to the first cylinder until right before the first fuel injection to the last cylinder is calculated according to the following equation (1) before the first fuel injection to each cylinder is conducted by the plurality of fuel injection valves. This calculation is performed not only when the engine is started at a very low temperature but also when the engine is started generally. The fuel pressure in the delivery pipe 2 at which the first fuel injection to the first cylinder is started is preset so that the first fuel injection to the last cylinder is conducted at a pressure higher than the rated discharge temperature of the low-pressure pump.

$$dP=(Q*n1-TAU*n2)*A/V \quad (1)$$

In the above equation (1), "V" is the capacity of a high-pressure portion in the high-pressure fuel supply system such as the delivery pipe 2, the high-pressure pipe 11 and the fuel pipes to each fuel injection valve 1. "Q" is the amount of fuel discharged from the high-pressure pump in each discharge operation during the first fuel injection to each cylinder, and "n1" is the number of times the high-pressure pump discharges fuel during the period from the first fuel injection to the first cylinder until right before the first fuel injection to the last cylinder. Therefore, "Q*n1" is the amount of fuel supplied to the high-pressure portion during the period from the first fuel injection to the first cylinder until right before the first fuel injection to the last cylinder. In the present exemplary embodiment, the internal combustion engine has four cylinders, and the high-pressure pump discharges fuel every time the fuel is injected to two cylinders. At least during the first fuel injection to each cylinder, the high-pressure pump force-feeds the maximum fuel discharge amount to the high-pressure portion. Therefore, "Q" is the maximum fuel discharge amount of the high-pressure pump, and "n1" means one time.

"TAU" is the amount of fuel injected to each cylinder in the first fuel injection, and is determined by an engine temperature and the like, and "n2" is the number of times the fuel is injected during the period from the first fuel injection to the first cylinder until right before the first fuel injection to the last cylinder. In other words, "n2" is equal to the number of cylinders in the internal combustion engine minus one. Therefore, "TAU*n2" is the amount of fuel consumed from the high-pressure portion during the period from the first fuel injection to the first until right before the first fuel injection to the last cylinder. "A" is the modulus of elasticity of the fuel. "A" may be a fixed value, but is preferably varied according to the fuel temperature.

Unless the temperature in the cylinders is sufficiently high as in a case where the engine is restarted right after the engine is stopped, the fuel pressure drop dP has a negative value so that the fuel pressure in the fuel injection to the last cylinder is reduced from the value at which the fuel injection to the first cylinder is started. The fuel pressure P at which the fuel injection to the first cylinder is started is preset so as to satisfy the relation given by the following equation (2):

$$P+dP=P1+a \quad (2).$$

"P+dP" is the fuel pressure in the high-pressure portion right before the first fuel injection to the last cylinder, "P1" is the rated discharge pressure of the low-pressure pump, and "a" is a constant. The fuel pressure P is thus preset in view of the fuel pressure drop dP. If the fuel injection amount in the first fuel injection to each cylinder is relatively small and dP has a positive value, dP is set to zero. This prevents the fuel pressure P from being preset to a value lower than the rated discharge pressure of the low-pressure pump and thus prevents the first fuel injection (the first fuel injection to each cylinder) from being conducted at a pressure lower than the rated discharge pressure of the low-pressure pump. Off course in this case, the fuel discharge amount of the high-pressure pump may be reduced from the maximum discharge amount so that dP becomes equal to zero. The fuel pressure P is accomplished by adjusting a number of discharging operations by the high-pressure pump 7 and fuel amount discharged per one discharging operation during the period from the start of cranking to the first fuel injection to the first cylinder.

In this way, the first fuel injection to each of the plurality of cylinders, including the first fuel injection to the last fuel injection, is conducted at a pressure higher than the rated discharge pressure of the low-pressure pump. This prevents evaporation of atomized fuel from being degraded due to a reduced fuel atomizing pressure. Therefore, satisfactory ignition of a mixture is ensured and misfire is prevented. As a result, favorable starting of the engine is implemented.

In the present exemplary embodiment, the fuel pressure in the delivery pipe 2 at which the first fuel injection (the first fuel injection to the first cylinder) is started is preset so that the fuel pressure right before the first fuel injection to the last cylinder is higher than the rated discharge pressure of the low-pressure pump. However, the fuel pressure in the delivery pipe 2 at which the first fuel injection (the first fuel injection to the first cylinder) may alternatively be preset so that the fuel pressure at the end of the the first fuel injection to the last cylinder is higher than the rated discharge pressure of the low-pressure pump. In this case, the injection pressure does not become lower than the rated discharge pressure of the low-pressure pump during the first fuel injection to the last cylinder, enabling the first fuel injection to the last fuel injection to be conducted in a more satisfactory manner. In order to preset the fuel pressure in this manner, the first fuel injection to the last cylinder is included in "n2" as the number of times the fuel is injected during the period from the first injection to the first cylinder to the first fuel injection to the last cylinder, and the fuel pressure drop dP is calculated using this value "n2".

In the present exemplary embodiment, the fuel pressure in the high-pressure portion right before the first fuel injection to the last cylinder is always estimated upon starting the engine in order to preset the fuel pressure at which the first fuel injection (the first fuel injection to the first cylinder) is started. However, upon warm starting the engine, the fuel injection amount in the first fuel injection to each cylinder and thus the fuel pressure drop dP is not as large. Accordingly, even if the fuel pressure at which the first fuel injection is started is fixed to a somewhat high value, the fuel pressure in the delivery pipe 2 does not become equal to or lower than the rated discharge pressure of the low-pressure pump in the first fuel injection to the last cylinder. When the engine is started at an extremely low temperature, the fuel pressure in the delivery pipe 2 in the first fuel injection to the last cylinder is likely to be equal to or lower than the rated discharge pressure of the low-pressure pump. Therefore, the fuel pressure at which the first fuel injection (fuel injection to the first cylinder) is started may be preset only when the engine is started at an extremely low temperature. In other words, the fuel pressure drop dP may be calculated and the fuel pressure in the delivery pipe 2 right before the fuel injection to the last cylinder may be estimated only when the engine is started at an extremely low temperature. If the fuel injection amount in the first fuel injection to each cylinder exceeds the fuel discharge amount of the high-pressure pump per fuel injection, the fuel pressure in the first fuel injection to the last cylinder is significantly reduced from the fuel pressure at which the first fuel injection to the first cylinder is started. Accordingly, the fuel pressure at which the first fuel injection to the first cylinder is started may be preset according to the above equations (1), (2) only when the fuel injection amount in the first fuel injection to each cylinder exceeds the fuel discharge amount of the high-pressure pump per fuel injection.

The controller 100 of the illustrated exemplary embodiments is implemented as one or more programmed general purpose computers. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hard-wired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more less or only a single element, are also within the spirit and scope of the invention.

What is claimed is:

1. A high-pressure fuel supply system of an internal combustion engine, comprising:

a high-pressure portion that supplies fuel to a plurality of fuel injection valves;

a high-pressure pump that supplies the fuel to the high-pressure portion;

a low-pressure pump that supplies the fuel to the high-pressure pump; and a controller that sets, in view of a fuel consumption amount consumed from the high-pressure portion through the fuel injection valves and a fuel supply amount supplied to the high-pressure portion by the high-pressure pump, a preset pressure at which fuel injection is started so that a first fuel injection to each cylinder of a plurality of cylinders by each of the plurality of fuel injection valves is conducted at a pressure higher than the rated discharge pressure of the low-pressure pump, wherein the fuel injection to a first cylinder of the plurality of cylinders is started after a pressure in the high-pressure portion is raised to the preset pressure by the high-pressure pump.

2. The high-pressure fuel supply system according to claim 1, wherein when a fuel injection amount in the first fuel injection to each cylinder of the plurality of cylinders upon starting the engine exceeds a fuel discharge amount of the high-pressure pump per fuel injection, the preset pressure is set in view of the fuel consumption amount and the fuel supply amount.

3. The high-pressure fuel supply system according to claim 2, wherein when the fuel injection amount in the first fuel injection to each cylinder of the plurality of cylinders upon starting the engine exceeds a maximum fuel discharge amount of the high-pressure pump, the preset pressure is set in view of the fuel consumption amount and the fuel supply amount.

4. The high-pressure fuel supply system according to claim 1, wherein a pressure drop in the high-pressure portion during a period from the first fuel injection to the first cylinder of the plurality of cylinders until an end or right before the first fuel injection in a last cylinder of the plurality of cylinders, where fuel injection occurs last, is estimated and the preset pressure is set on the basis of the pressure drop so that the fuel pressure in the high-pressure portion at the first fuel injection in each cylinder of the plurality of cylinders becomes higher than the rated discharge pressure of the low-pressure pump.

5. The high-pressure fuel supply system according to claim 4, wherein the fuel pressure in the high-pressure portion right before the first fuel injection in the last cylinder of the plurality of cylinders is estimated based on the pressure drop in the high-pressure portion, the pressure drop being determined in view of a difference between the fuel consumption amount consumed from the high-pressure portion through the fuel injection valve during a period from the first fuel injection to the first cylinder of the plurality of cylinders until right before the first fuel injection to the last cylinder of the plurality of cylinders and the fuel supply amount supplied to the high-pressure portion by the high-pressure pump during the period from the first fuel injection to the first cylinder until right before the first fuel injection to the last cylinder of the plurality of cylinders, and the preset pressure is set so that the estimated fuel pressure becomes higher than the rated discharge pressure of the low-pressure pump.

6. The high-pressure fuel supply system according to claim 4, wherein the fuel pressure in the high-pressure portion at an end of the first fuel injection to the last cylinder of the plurality of cylinders is estimated based on the pressure drop in the high-pressure portion, the pressure drop being determined in view of a difference between the fuel consumption amount consumed from the high-pressure portion through the fuel injection valve during a period from the first fuel injection to the first cylinder of the plurality of cylinders until the end of the first fuel injection to the last cylinder of the plurality of cylinders and the fuel supply amount supplied to the high-pressure portion by the high-pressure pump during a period from the first fuel injection to the first cylinder of the plurality of cylinders until right before the first fuel injection to the last cylinder of the plurality of cylinders, and the preset pressure is set so that the estimated fuel pressure becomes higher than the rated discharge pressure of the low-pressure pump.

7. The high-pressure fuel supply system according to claim 4, wherein the pressure drop in the high-pressure portion is estimated, the pressure drop being determined in view of a difference between the fuel consumption amount consumed from the high-pressure portion through the fuel injection valve during a period from the first fuel injection to the first cylinder of the plurality of cylinders until right before the first fuel injection to the last cylinder of the plurality of cylinders and the fuel supply amount supplied to the high-pressure portion by the high-pressure pump during the period from the first fuel injection to the first cylinder of the plurality of cylinders until right before the first fuel injection to the last cylinder of the plurality of cylinders, and the preset pressure is set based on the estimated pressure drop so that the fuel pressure in the high-pressure portion right before the first fuel injection to the last cylinder becomes higher than the rated discharge pressure of the low-pressure pump.

8. The high-pressure fuel supply system according to claim 4, wherein the pressure drop in the high-pressure portion is estimated, the pressure drop being determined in view of a difference between the fuel consumption amount consumed from the high-pressure portion through the fuel injection valve during a period from the first fuel injection to the first cylinder of the plurality of cylinders until an end of the first fuel injection to the last cylinder of the plurality of cylinders and the fuel supply amount supplied to the high-pressure portion by the high-pressure pump during a period from the first fuel injection to the first cylinder of the plurality of cylinders until right before the first fuel injection to the last fuel injection, and the preset pressure is set based on the estimated pressure drop so that the fuel pressure in the high-pressure portion right before the first fuel injection to the last cylinder of the plurality of cylinders becomes higher than the rated discharge pressure of the low-pressure pump.

9. The high-pressure fuel supply system according to claim 4, wherein the pressure drop is calculated when an atmospheric temperature is lower than a prescribed value, and the preset pressure is set based on the calculated pressure drop.

10. The high-pressure fuel supply system according to claim 4, wherein the pressure drop is determined further in view of a modulus of elasticity of the fuel and a capacity of the high-pressure portion.

11. The high-pressure fuel supply system according to claim 10, wherein the modulus of elasticity is determined based on a temperature of the fuel.

12. A method for controlling a high-pressure fuel supply system of an internal combustion engine with a high-pressure portion that supplies fuel to a plurality of fuel injection valves, a high-pressure pump that supplies the fuel to the high-pressure portion, and a low-pressure pump that supplies the fuel to the high-pressure pump, comprising:

calculating a fuel consumption amount consumed from the high-pressure portion through the fuel injection valve;

calculating a fuel supply amount supplied to the high-pressure portion by the high-pressure pump; and setting a preset pressure in the high-pressure portion, in view of the fuel consumption amount and the fuel supply amount, at which fuel injection is started so that first fuel injection to each cylinder of a plurality of cylinders by each of the plurality of fuel injection valves is conducted at a pressure higher than a rated discharge pressure of the low-pressure pump.

13. The method of claim 12, wherein when a fuel injection amount in the first fuel injection to each cylinder of the plurality of cylinders upon starting the engine exceeds a fuel discharge amount of the high-pressure pump per fuel injection, the preset pressure is set in view of the fuel consumption amount and the fuel supply amount.

14. The method of claim 13, wherein when the fuel injection amount in the first fuel injection to each cylinder of the plurality of cylinders upon starting the engine exceeds a maximum fuel discharge amount of the high-pressure pump, the preset pressure is set in view of the fuel consumption amount and the fuel supply amount.

15. The method of claim 12, wherein a pressure drop in the high-pressure portion during a period from the first fuel injection to a first cylinder of the plurality of cylinders until an end or right before the first fuel injection in a last cylinder of the plurality of cylinders, where fuel injection occurs last, is estimated and the preset pressure is set on the basis of the pressure drop so that the fuel pressure in the high-pressure portion at the first fuel injection in each cylinder of the plurality of cylinders becomes higher than the rated discharge pressure of the low-pressure pump.

16. The method of claim 15, wherein the fuel pressure in the high-pressure portion right before the first fuel injection in the last cylinder of the plurality of cylinders is estimated based on the pressure drop in the high-pressure portion, the pressure drop being determined in view of a difference between the fuel consumption amount consumed from the high-pressure portion through the fuel injection valve during a period from the first fuel injection to the first cylinder of the plurality of cylinders until right before the first fuel injection to the last cylinder of the plurality of cylinders and the fuel supply amount supplied to the high-pressure portion by the high-pressure pump during the period from the first fuel injection to the first cylinder until right before the first fuel injection to the last cylinder of the plurality of cylinders, and the preset pressure is set so that the estimated fuel pressure becomes higher than the rated discharge pressure of the low-pressure pump.

17. The method of claim 15, wherein the fuel pressure in the high-pressure portion at an end of the first fuel injection to the last cylinder of the plurality of cylinders is estimated based on the pressure drop in the high-pressure portion, the pressure drop being determined in view of a difference between the fuel consumption amount consumed from the high-pressure portion through the fuel injection valve during a period from the first fuel injection to the first cylinder of the plurality of cylinders until the end of the first fuel injection to the last cylinder of the plurality of cylinders and the fuel supply amount supplied to the high-pressure portion by the high-pressure pump during a period from the first fuel injection to the first cylinder of the plurality of cylinders until right before the first fuel injection to the last cylinder of the plurality of cylinders, and the preset pressure is set so that the estimated fuel pressure becomes higher than the rated discharge pressure of the low-pressure pump.

18. The method of claim 15, wherein the pressure drop in the high-pressure portion is estimated, the pressure drop being determined in view of a difference between the fuel consumption amount consumed from the high-pressure portion through the fuel injection valve during a period from the first fuel injection to the first cylinder of the plurality of cylinders until right before the first fuel injection to the last cylinder of the plurality of cylinders and the fuel supply amount supplied to the high-pressure portion by the high-pressure pump during the period from the first fuel injection to the first cylinder of the plurality of cylinders until right before the first fuel injection to the last cylinder of the plurality of cylinders, and the preset pressure is set based on the estimated pressure drop so that the fuel pressure in the high-pressure portion right before the first fuel injection to the last cylinder becomes higher than the rated discharge pressure of the low-pressure pump.

19. The method of claim 15, wherein the pressure drop in the high-pressure portion is estimated, the pressure drop being determined in view of a difference between the fuel consumption amount consumed from the high-pressure portion through the fuel injection valve during a period from the first fuel injection to the first cylinder of the plurality of cylinders until an end of the first fuel injection to the last cylinder of the plurality of cylinders and the fuel supply amount supplied to the high-pressure portion by the high-pressure pump during a period from the first fuel injection to the first cylinder of the plurality of cylinders until right before the first fuel injection to the last fuel injection, and the preset pressure is set based on the estimated pressure drop so that the fuel pressure in the high-pressure portion right before the first fuel injection to the last cylinder of the plurality of cylinders becomes higher than the rated discharge pressure of the low-pressure pump.

20. The method of claim 15, wherein the pressure drop is calculated when an atmospheric temperature is lower than a prescribed value, and the preset pressure is set based on the calculated pressure drop.

21. The method of claim 15, wherein the pressure drop is determined further in view of a modulus of elasticity of the fuel and a capacity of the high-pressure portion.

22. The method of claim 21, wherein the modulus of elasticity is determined based on a temperature of the fuel.

* * * * *